United States Patent [19]

Walther

[11] Patent Number: 4,555,815

[45] Date of Patent: Dec. 3, 1985

[54] PROTECTIVE HELMET WITH RELEASABLY CONNECTED PROTECTIVE BREATHING MASK

[75] Inventor: Hans J. Walther, Lubeck, Fed. Rep. of Germany

[73] Assignee: Drägerwerk Aktiengesellschaft, Lubeck, Fed. Rep. of Germany

[21] Appl. No.: 569,599

[22] Filed: Jan. 10, 1984

[30] Foreign Application Priority Data

Jan. 11, 1984 [DE] Fed. Rep. of Germany ..... 3300646

[51] Int. Cl.[4] ..... A42B 3/00

[52] U.S. Cl. ..... 2/424; 2/6; 2/10

[58] Field of Search ..... 2/424, 422, 421, 429, 2/425, 10, 9, 8, 6; 128/201.24, 206.21, 206.27, 207.11

[56] References Cited

U.S. PATENT DOCUMENTS 3,833,935 9/1974 Ansite et al. ..... 2/6

4,083,065 4/1978 Warncke ..... 2/424

4,136,403 1/1979 Walther et al. ..... 2/6 X

*Primary Examiner*—Henry S. Jaudon

*Assistant Examiner*—J. L. K. Olds

*Attorney, Agent, or Firm*—McGlew and Tuttle

[57] ABSTRACT

In addition to protective helmets, a breathing protection is required time and again. This purpose is served by a protective breathing mask. It must be made possible to put the mask on in a simple way with one hand, but reliably and in combination with the protective helmet. To this end, the mask is provided with locking means comprising coupling hooks to be moved by means of spreading dogs. While pushing the dogs together, the coupling hooks are displaced outwardly, to spread apart at the end of this motion. Upon putting on the protective mask and releasing the hold of the spreading dogs, the hooks get clamped to the protective helmet where they engage catch seats to lock the mask to the helmet. The breathing mask is thus firmly held toward the face to be protected. The mask is removed in an equally simple way, by pushing the spreading dogs together.

7 Claims, 3 Drawing Figures

PROTECTIVE HELMET WITH RELEASABLY CONNECTED PROTECTIVE BREATHING MASK

FIELD AND BACKGROUND OF THE INVENTION

This invention relates in general to breathing apparatus and in particular to a new and useful protective helmet and breathing mask with interconnectable means.

Wearing of protective helmets has become a matter of course. Frequently, a protective breathing mask is to be put on in addition. For this purpose, the mask and the helmet must be adapted to each other. It must be ensured that the helmet will not prevent the mask from being put on quickly, in a simple manner, and securely. Strappings on the mask would be a serious obstacle.

A prior art protective helmet combined with a breathing mask through a disengageable connection does permit the fixing of a strapless mask to a protective helmet which is already put on, however, this cannot be done single-handedly. The helmet is equipped with a locking mechanism comprising pins on each temple side, which can be pivoted to engage opposite snap seats extending about parallel to the mask rim. The pin is guided in an eccentric bore of a rotary body, and is pushed by a compression spring from the locking mechanism into the opposite snap seat. The pin is guided on the rotary body in a triangular opening of a gripping sleeve, through a dog. To put it on, the mask is pushed onto the face. The locking pins engage the snap seats on both sides. By turning the gripping sleeves, the rotary bodies and thus the pins are taken along. They pull the mask to the face due to the motion in the snap seats (German Pat. No. 2 54 979).

This prior art mechanism cannot be handled by one hand alone. Both hands are needed for a simultaneous and uniform fitting of the mask.

In another prior art protective mask combined with a protective helmet, no mask harness is provided, however, the mask is of usual design. The two parts are connected to each other by mechanisms comprising a catch bell on the helmet and a coupling pin on the mask. The pins are introduced into the bell and engage, through snap balls, a catch groove where they are held locked. The parts are separated from each other by pushing an unlocking mechanism, with the snap balls yielding radially, in the direction of the pin axis. The catch bells are secured to the helmet by clamping pins through which they can be adjusted in position. The mask already put on is sealed by tightening the pins (German Pat. No. 26 40 701).

Here again, both hands are needed for putting the mask on. Bulky parts are needed on the helmet to effect the connection, namely the catch bell with the clamping pins. This makes the helmets generally unsuitable for being connected to breathing masks.

SUMMARY OF THE INVENTION

The invention is directed to a device permitting a protective mask to be put on in a reliable manner and single-handedly and requiring no further clamping manipulation.

In accordance with the invention, a protective helmet is combined with a strapless protective breathing mask through a disengageable connection which is formed by interengaged locking means. Locking means comprise on each side of the mask and helmet a coupling hook which is connected through a push rod which slides in a guide tube to laterally displaceable spreading dogs. The guide tube is provided on a mounting saddle which forms the lower portion of a viewing window of the protective mask. In one embodiment, the coupling hooks engage into recesses on each side of the helmet. Tension springs hold the hooks in engagement and they are released by moving the dogs toward the center toward each other against the tensioning of the springs to permit release of the hooks from the helmet.

This solution has the advantage that while going to put the mask on, coupling hooks can be extended and spread apart by single-handedly pushing together spreading dogs which are provided at the most suitable location. The mask can then be brought to the face, into the correct position for sealing. Then, while releasing the spreading dogs, the coupling hooks return into their initial position and engage the catch seats of the helmet. The helmet along with the mask form together a protective unit for the user. The mask is removed again single-handedly, in the reversed order, upon pushing the spreading dogs together.

Accordingly, it is an object of the invention to provide an improved construction facilitating the wearing of a breathing mask with a protective helmet and which permits easy coupling and uncoupling of the mask from the helmet preferably by using only one hand.

A further object of the invention is to provide protective helmet which is usable with a breathing mask with a releasable coupling for holding the mask to the helmet preferably on each side of the helmet and which includes hooks which are carried on one of the breathing mask and helmet which are engageable in recesses on the other of the breathing mask and helmet and which includes hand engageable dogs which may be moved against the force of a tensioning spring which holds the mask in coupling engagement with the helmet through engagement of the hooks so as to permit the hooks to be released or to be moved to a position in which they may be easily engaged and subsequently tensioned by the springs after the dogs are released.

A further object of the invention is to provide a device for coupling the helmet to a breathing mask which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 2, 3:
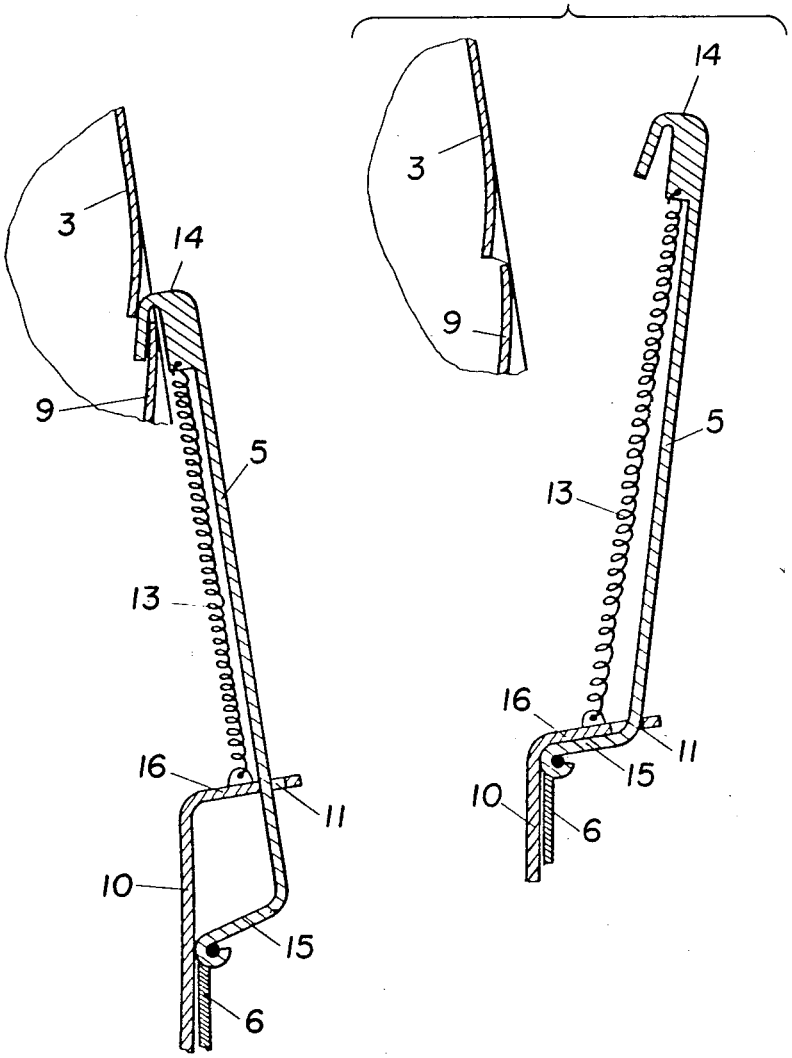
FIG. 2 is an enlarged partial sectional view showing elements of the breathing mask to helmet with the coupling elements in a locking position.
FIG. 3 is a view similar to FIG. 2 showing the parts in a disengaged or unlocked position.

Referring to the drawings in particular the invention embodied therein comprises a protective helmet 1 which shown on a wearer interconnected with a protective breathing mask generally designated 2. In accordance with the invention, mask 2 may be coupled to the helmet 1 by a disengageable coupling hook 5 which in the embodiment shown engages in a recess or slot 3 of the helmet 1. In accordance with the invention, a mounting saddle 10 is advantageously provided on the mask 2 and it provides a mounting for a guide tube 12 which is positioned around a front portion of the saddle 10 which provides a mounting for a viewing window 20. A push rod 6 is slidable in the guide tube 12 for each coupling hook 5 and in the embodiment shown, a coupling hook is provided for each side and each slides in the guide tube 12 and is connected to respective coupling hook 5. Biasing means including a spring 13 effect the biasing of the coupling hook 5 so that it engages into the slide and holds the mask to the helmet. In order to facilitate either the placing on of the mask 2 or its removal the invention provides hand engageable dogs 8 which engage each push rod 6 to permit movement of the push rod in a direction to overcome the biasing means for example in the direction opposite to the arrow 7 to permit the head 14 of the coupling hooks 5 to disengage from the slot 3 of the helmet 1 as shown in FIG. 3.

Figure 1:
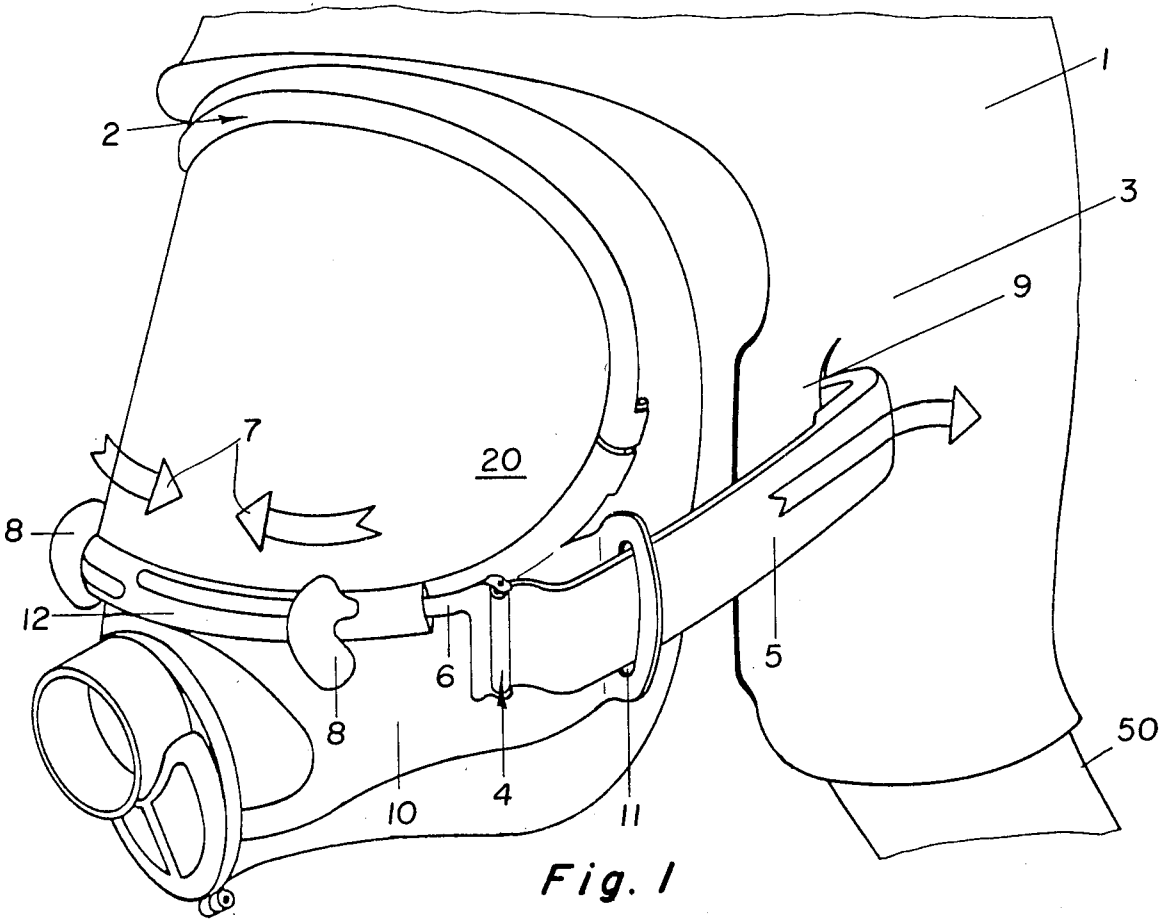
FIG. 1 is a front left side view of a person wearing a protective helmet and breathing mask which are coupled together and constructed in accordance with the invention.

FIG. 1 shows a protective helmet 1 and a protective mask 2, both in position of use. Mask 2 has no straps, yet is designed in the conventional manner. The disengageable connection between helmet 1 and mask 2 is effected on both sides by locking means 4. The locking means 4 substantially comprise coupling hooks 5 which can be moved through push rods 6, by displacing spreading dogs 8 in the direction of arrows 7. Catch seats 9 are provided on the helmet shell 3 for engaging coupling hooks 5.

To the mask 2, locking means 4 are secured by means of a mounting saddle 10 forming at the same time the lower portion of a window mount or window surround for viewing window 20. Coupling hooks 5 are guided along mounting saddle 10 in slide apertures 11. Push rods 6 carrying spreading dogs 8 are received in a guide tube 12. A tension spring 13 forms a connection between the head 14 of coupling hook 5 and mounting saddle 10 and holds the hook engaged. Upon pushing spreading dogs 8 toward each other, i.e. toward the center, push rods 6 are moved in mutually opposite directions outwardly and coupling hooks 5 are displaced in slide abutments 16 of mounting saddle 10, cause their spreading apart sidewards of mask 2.

Upon releasing spreading dogs 8, coupling hooks 5 are pulled by tension springs 13 toward protective helmet 1 and into mounting saddle 10, while heads 14 of the coupling hooks engage into recesses such as indentations or catch seats 9. Mask 2 is then forced by tension springs 13 to sealingly fit the user's face.

To separate mask 2 from helmet 1, it suffices to push spreading dogs 8 with one hand together. Coupling hooks 5 are thereby withdrawn from catch seats 9 and brought into a spread-apart position. Mask 2 can then be removed from the face.

While specific embodiments of the invention have been shown and described in detail to illustrate the application of the principles of the invention, it will be understood that the invention may be embodied otherwise without departing from such principles.

What is claimed is:

1. A protective helmet combined with a strapless protective breathing mask, comprising locking means associated with said helmet and mask including a mounting saddle having a tubular guide on said mask, a push rod slidable in said tubular guide, a coupling hook engageable with said push rod and with said helmet, biasing means biasing said push rod with said coupling hook in a direction to hold said coupling hook in a biased locking position to hold said mask and said helmet together, and a hand engageable dog connected to said push rod to move said push rod against said biasing means to permit disengagement of said coupling hook and also to permit engagement of said coupling hook with said helmet.

2. A protective helmet according to claim 1, wherein said mask includes said mounting saddle having said tubular guide and including a coupling hook on each side of said tubular guide and an associated push rod for each said coupling hook, said biasing means holding said push rods in a position in which said dogs associated with said push rods are in spread apart positions, said dogs being moved in directions toward and away from each other.

3. A protective helmet according to claim 2, wherein each said coupling hook includes members pivoted to said push rods, said biasing means including a spring connected between said mounting saddle and said coupling hook which is engageable with said helmet, said mounting saddle including an outwardly extending portion and said coupling hook including an oblique stop portion which is engageable with said outwardly extending portion, said spring holding said coupling hook in a position in which it extends obliquely outwardly away from the associated helmet when it is in a released position.

4. A protective helmet according to claim 1, wherein said mask includes a front viewing window, said mounting saddle comprising a portion extending below said front viewing window and said tubular guide comprising a tube extending around said mask below said front viewing window, said tube having slots carrying said dogs which are movable in said slots toward and away from each other, said push rod comprising a rod extending out of each end of said tubular guide and connected to a respective coupling hook on each side of said mask.

5. A helmet which is combinable with a mask including side portions on each side having a receiving recess, and a breathing mask engageable with said helmet having a front portion with a saddle extending therearound, a guide tube mounted on said saddle and having an opening on each side, a push rod extending from said guide tube out of the opening on each side, a coupling hook connected to the outer end of each push rod and having an outer end with a hook portion engageable in each receiving recess, spring means connected to each push rod and urging each push rod in respective opposite directions so as to cause each coupling hook to engage in each receiving recess of said helmet, and a dog engageable by hand connected to each guide tube and being movable along said guide tube for permitting released and locking biased engagement of said coupling hooks.

6. A helmet and mask according to claim 5, wherein each receiving recess includes indentations on each side thereof into which said coupling hooks are engaged.

7. A helmet according to claim 5, wherein said coupling hooks comprise a holding strap made of stiff elastic material.

* * * * *